United States Patent [19]

Chestnut

[11] 4,384,176

[45] May 17, 1983

[54] DOUBLE ACTING SWITCH

[75] Inventor: Benjamin F. Chestnut, Indianapolis, Ind.

[73] Assignee: Emhart Industries, Inc., Indianapolis, Ind.

[21] Appl. No.: 316,559

[22] Filed: Oct. 30, 1981

[51] Int. Cl.[3] ..... H01H 9/00

[52] U.S. Cl. ..... 200/1 A; 200/86.5; 200/153 LA

[58] Field of Search ..... 200/1 A, 5 A, 5 B, 5 E, 200/61.76, 61.89, 61.91, 283, 159 A, 160, 153 J, 153 LA, 1 B, 6 B, 6 BB, 86.5

[56] References Cited

U.S. PATENT DOCUMENTS

| | | | |
|---|---|---|---|
| 1,919,206 | 7/1933 | Douglas | 200/61.89 X |
| 2,658,123 | 11/1953 | Von Stoeser | 200/153 LA |
| 4,239,947 | 12/1980 | Breitung et al. | 200/153 LA |

*Primary Examiner*—A. T. Grimley
*Assistant Examiner*—Morris Ginsburg
*Attorney, Agent, or Firm*—R. F. Meyer; D. W. Gomes

[57] ABSTRACT

An axially spring biased plunger has a cam which upon simultaneous engagement with a pair of switches opens one of the switches while closing the other.

8 Claims, 3 Drawing Figures

DOUBLE ACTING SWITCH

BACKGROUND OF THE INVENTION

Generally speaking, the present invention relates to a double acting switch which comprises a housing; first and second switches each comprising a fixed contact blade and a movable contact blade and electrical contacts at distal ends of the fixed and movable contact blades and mating each other, a cam follower extending from the movable contact blade, the first switch extending into the housing from an end thereof, the second switch extending into the housing from an opposite end thereof; an axially spring biased plunger slideably carried in the housing to be axially movable between the first and second switches; cam means carried by the plunger and selectively engaging the cam follower of the first and second switches, the cam means including coded indicia programmed to open one of the first and second switches while closing the other; and individual electrical terminals extending from outside and into the housing and electrically connected to the fixed and movable contact blades of each of the first and second switches.

The double acting switch of the present invention is particularly useful in automobiles to energize tail lights when a brake pedal is depressed and to simultaneously provide a feed circuit to a cruise control system to break the circuit and de-energize the system. Such double acting switches are well known in the art. However, for the most part, prior art double acting switches were complicated and costly to manufacture.

OBJECTS OR FEATURES OF THE INVENTION

Accordingly, it is a feature of the present invention to provide a double acting switch having a minimum number of parts and, therefore, easy to produce. Another feature of the invention is to provide a double acting switch having first and second switches which are actuated by an axially moving spring biased plunger. It is another feature of the invention to provide such a switch wherein there is a cam means carried by the plunger having coded indicia programmed to open one of the switches while closing the other. These and other features of the invention will become apparent from the following description taken in conjunction with the accompanying drawings.

DETAILED DESCRIPTION OF THE INVENTION

Figure 1:
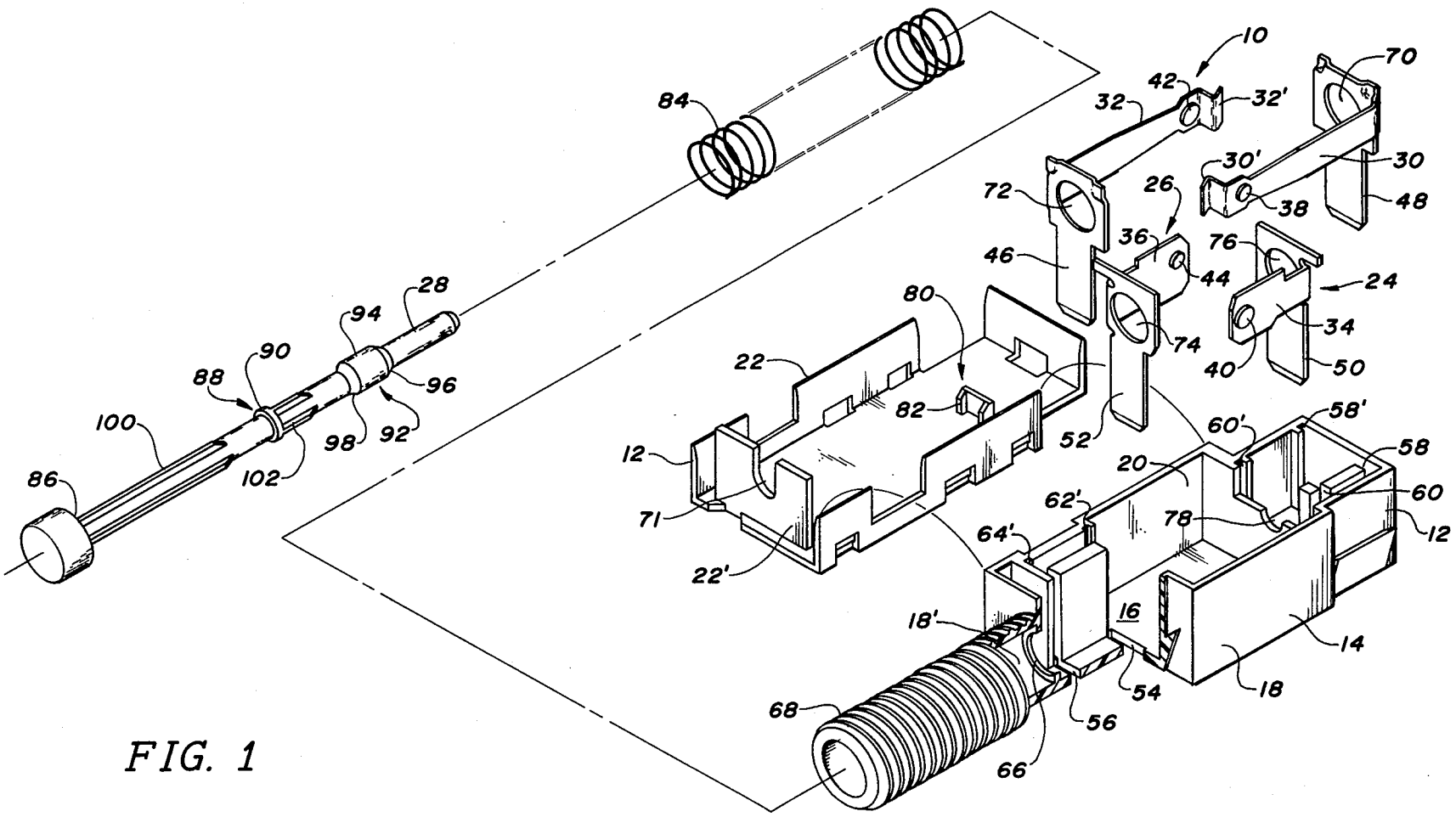
FIG. 1 is an exploded view of a double acting switch employing the features of the invention.

Referring to the drawings, there is shown a double acting switch 10 that is enclosed in a housing 12. The housing is composed of a cup-shaped member 14 having a base 16 and side and end walls 18 with an open end 20 that is enclosed by a cover 22. The double acting switch, in general, includes two switches 24 and 26 which are substantially simultaneously activated through a plunger 28. As shown, each of the switches 24 and 26 include movable electrical contact blades 30 and 32, and corresponding fixed electrical contact blades 34 and 36. Movable blade 30 has at its distal end an electrical contact 38 which mates with an electrical contact 40 carried by the fixed contact blade 34. In like manner, movable blade 32 has an electrical contact 42 at its distal end which mates with electrical contact 44 carried by fixed contact 36. Each movable blade includes a cam follower 30' and 32'. All of the blades are integral with electrical terminals 46, 48, 50 and 52. All of the electrical terminals extend through base 16 of housing 12 through slots similar to slots 54 and 56. In addition, each of the electrical terminals are carried in the side walls 18 through opposing slots 58 58', 60 60', 62' and 64' with the opposing slots for 62' and 64' not being shown. As is better shown in FIGS. 2 or 3, the electrical terminals with their respective electrical contact blades are carried in the housing at opposed ends such that the blades of one of the switches are pointed at the blades of the other switch. The switches are also along opposite side walls of the housing to provide a space 35 through which a plumger 28 can axially move.

Figure 3:
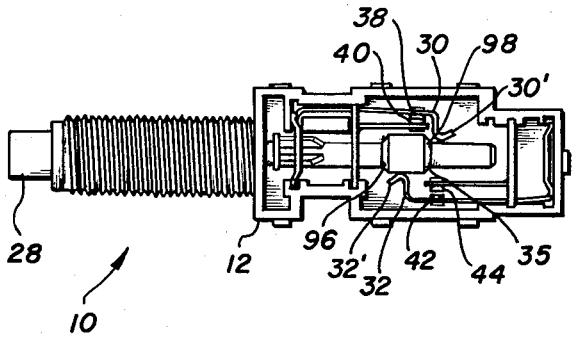
FIGS. 2 and 3 are elevations in partial cross-section with a housing cover removed showing two operating modes of the double acting switch.
Figure 2:
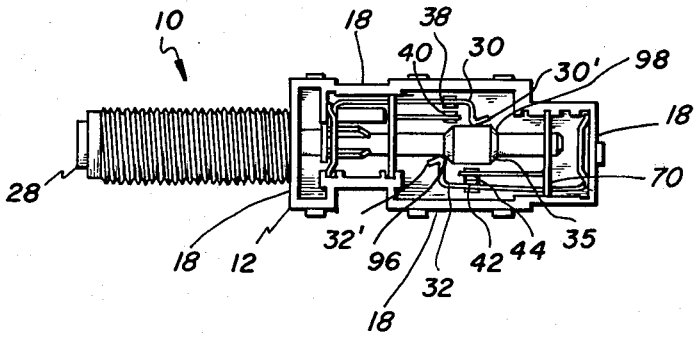

Plunger 28 is slideably carried within the housing 12 and extends outside the housing through an aperture 66 and through a threaded sleeve 68 which is integrally formed with the housing 12 in line with aperture 66. The threaded sleeve permits the double acting switch to be carried by the appropriate member of an automobile, for example a floor board for a brake pedal. The plunger extends through aperture 71 of end wall 22' of cover 22 and aperatures 70, 72, 74 and 76 of the electrical terminals. The plunger rides on a shelf 78 and is held against the shelf by a guide means 80 which includes a tang 82 which engages the plunger when cover 22 is positioned in place. As best shown in FIGS. 2 and 3, the plunger moves axially between the cam followers 30' and 32' of the movable blades. The plunger is axially spring biased through a coil spring 84 which surrounds the plunger inside sleeve 68 and is biased between a collar 86 of the plunger and end wall 18' at aperture 66. Coil spring 84 is prevented from buckling by ribs 100. A stop means 88 prevents the plunger from moving out of the housing and includes a collar 90 which engages the inner surface of end wall 22'.

Switches 24 and 26 are opened and closed through a cam means 92 which includes a cylinder 94 having opposed end surfaces 96 and 98 which are anticlinal to provide ramps slanted in opposite directions.

The operation of the device can best be seen with reference to FIGS. 2 and 3 wherein cover 22 has been removed. Referring to FIG. 2, plunger 28 is held in by way of releasing a brake pedal (not shown). In this position, cam follower 32' of movable blade 32 has moved down ramp 96 of the cam means to permit electrical contact 42 to engage electrical contact 44 and thus close a circuit to a cruise control, for example. Substantially simultaneously cam follower 30' of movable blade 30 has moved up ramp 98 to open electrical contacts 38 and 40 to open an automobile tail light circuit, for example. FIG. 3 shows the opposite condition where the plunger 28 is in the released position, for example, by depressing the brake pedal.

What is claimed is:

1. A double acting switch comprising:

(a) a housing;

(b) first and second switches each comprising: a fixed electrical contact blade and a movable electrical contact blade and electrical contacts at distal ends of said fixed and movable contact blades and mating each other, a cam follower extending from said movable electrical contact blade, said first switch extending into said housing from an end thereof, said second switch extending into said housing from an opposite end thereof;

(c) an axially spring biased plunger slideably carried in said housing to be axially movable between said first and second switches;

(d) cam means carried by said plunger and selectively engaging said cam follower of said first and second switches, said cam means including coded indicia programmed to open one of said first and second switches while closing the other; and (e) individual electrical terminals extending from outside and into said housing and electrically connected to said fixed and movable contact blades of each of said first and second switches and having apertures through which said axially spring biased plunger moves.

2. A double acting switch according to claim 1 wherein said coded indicia includes first and second ramp means slanted in opposite direction.

3. A double acting switch according to claim 2 wherein said first and second ramp means comprises a cylinder the opposed end surfaces of which are anticlinal.

4. A double acting switch according to claim 1 further comprising stop means limiting the axial movement of said axially spring biased plunger.

5. A double acting switch according to claim 5 wherein said stop means includes a collar carried by said plunger engaging an end wall of said housing.

6. A double acting switch according to claim 1 further including guide means engaging said axially spring biased plunger to maintain same in alignment.

7. A double acting switch according to claim 6 wherein said guide means includes a tang extending from said housing and engaging said axially spring biased plunger.

8. A double acting switch according to claim 1 wherein said axially spring biased plunger is carried in a sleeve extending from an end of said housing from an opening in said housing through which said plunger axially moves, a collar at an end of said plunger, and a coil spring surrounding said plunger and biased against said collar and said end of said housing.

* * * * *